United States Patent [19]

Vreeland

[11] 4,112,192

[45] * Sep. 5, 1978

[54] METHOD OF FINISHING COATED PAPER

[75] Inventor: Jay H. Vreeland, Yarmouth, Me.

[73] Assignee: Scott Paper Company, Philadelphia, Pa.

[ * ] Notice: The portion of the term of this patent subsequent to Mar. 25, 1992, has been disclaimed.

[21] Appl. No.: 612,440

[22] Filed: Sep. 11, 1975

Related U.S. Application Data

[62] Division of Ser. No. 476,467, Jun. 5, 1974, abandoned, which is a division of Ser. No. 331,815, Feb. 12, 1973, Pat. No. 3,873,345.

[51] Int. Cl.[2] ..... D21H 1/28; C08F 33/08

[52] U.S. Cl. ..... 428/511; 427/391; 428/512

[58] Field of Search ..... 427/391; 428/511, 512; 260/29.6 R

[56] References Cited

U.S. PATENT DOCUMENTS

| | | | |
|---|---|---|---|
| 2,949,382 | 8/1960 | Dickerman et al. | 427/391 X |
| 3,132,042 | 5/1964 | Weber | 428/511 X |
| 3,228,785 | 1/1966 | Growald et al. | 260/29.6 RW |
| 3,288,632 | 11/1966 | Rush | 428/511 X |
| 3,340,216 | 9/1967 | Mack | 260/29.6 F |
| 3,583,881 | 6/1971 | Kennedy | 427/391 X |
| 3,634,298 | 1/1972 | Wamsley et al. | 260/86.7 X |
| 3,664,912 | 5/1972 | Olson | 260/42.47 |
| 3,779,800 | 12/1973 | Heiser | 260/8 |

*Primary Examiner*—Michael R. Lusignan
*Attorney, Agent, or Firm*—R. Duke Vickrey; John W. Kane, Jr.

[57] ABSTRACT

Production of high-gloss coated paper with heated calendering apparatus through the use of a coating composition comprising pigment and a hard latex binder.

6 Claims, 3 Drawing Figures

METHOD OF FINISHING COATED PAPER

This is a division of application Ser. No. 476,467, filed June 5, 1974, now abandoned, which is a division of application Ser. No. 331,815, filed Feb. 12, 1973, now U.S. Pat. No. 3,873,345.

BACKGROUND OF THE INVENTION

1. Field of the Invention

The present invention relates to a method of producing highgloss coated papers with heated calendering apparatus through the use of coating compositions comprising pigments and synthetic polymeric latices.

2. Description of the Prior Art

High-gloss coated papers can be produced by the application of an aqueous coating composition containing pigment and thermoplastic binder and subsequently developing gloss in the coated paper by means of hot calendering, such as by supercalendering or gloss calendering. A supercalender comprises a "stack" of alternating steel calender rolls and resilient backing rolls, with means for heating the steel rolls or heat being generated by friction. Usually the paper web is threaded through the stack, thus wrapping the heated roll for a considerable portion of its circumference. Alternatively, the paper web may be passed directly through the nip formed by the heated roll and the backing roll by the use of fly rolls. The use of a supercalender involves relatively high nip pressures, generally in the range of 1000 to 2000 pounds per linear inch (pli) and typically 1200–1600 pli. The temperatures of the steel finishing rolls are generally 140° to 180° F. While supercalendering suffers from the disadvantage of compacting and densifying the coated paper web during the calendering operation, it has the advantage of greater speed and lower cost of equipment relative to gloss calendering which is almost invariably done in-line with the coating operation.

The method of finishing coatings on paper by means of hot calendering known in the paper-coating art as "gloss calendering" involves the production of a glossy surface on paper or related web materials by contacting the surface of a coated substrate with a polished finishing drum under temperature conditions sufficient to cause a temporary condition of plasticity in the surface to thereby obtain a high degree of finish or gloss without unduly compacting the substrate. This higher bulk compared to that obtained by supercalendering leads to increased brightness and opacity, which are desirable properties in coated printing papers, and permits the use of a lighter basis weight paper to provide a given caliper. In gloss-calendering of paper, an aqueous coating composition is applied to a paper web, the web is calendered in the nip formed between a gloss-calender drum and the resilient backing roll and the paper web is removed from contact with the drum as it emerges from the nip. The pressure conditions in the gloss-calender nip are generally lower, e.g., 500–900 pli, than in the supercalender, and the temperature conditions are typically higher —275°–350° F.

Aqueous paper coating compositions generally comprise a mineral component, which is preferably predominantly clay, but may also include other mineral pigments such as titanium dioxide, zinc sulfide, or calcium carbonate, and a thermoplastic binder. It has recently been suggested (in U.S. Pat. No. 3,583,881 granted June 8, 1971) that so-called "hard" polymers be employed as the binder material in a paper coating composition in order to obtain a high gloss coated paper product. By "hard" is meant that the thermoplastic polymer has a relatively high apparent second order transition temperature or inflection temperature, more commonly in the paper coating art called the glass transition temperature ($T_g$), which may be found by plotting Young's modulus of rigidity against temperature.

Each polymer has its own "glass transition temperature" ($T_g$); this term is well known in the art and is generally used to define or describe a temperature above which the polymer has acquired sufficient thermal energy for molecular rotational motion or considerable torsional oscillation to occur about the majority of bonds in the main chain. This term is also used to define a "minimum film forming temperature" of polymer latices above which the polymer particles are capable of being coalesced by surface tension upon evaporation of water to form a film. In effect, then, the term "glass transition temperature" or "minimum film forming temperature" describes a type of internal "melting" point for polymer latices, but not a phase change, at and about which the polymer preserves the outward appearance of a solid but at the same time behaves more like a viscous liquid in its ability to undergo plastic flow and elastic deformation. For the purposes of this invention, the term "glass transition temperature" may be used interchangeably with and defined as the "minimum film forming temperature" of a polymer latex. In actuality, this "transition" occurs over a small range of temperatures rather than an exact point.

From this definition it may be seen that if the temperature T is taken as room temperature (68° to 77° F or 20° to 25° C), then any polymer having a Tg substantially greater than T, for example, 90° F or 32° C, will be a non-film former at T, while any polymer with a Tg substantially below T, for example 60° F or 16° C, will be a relatively good film former at T. In the art to which the present invention pertains, the expression "hard" refers to binders having a Tg substantially greater than room temperature and generally a Tg in excess of 100° F or 38° C.

It is stated in the above-mentioned patent U.S. Pat. No. 3,583,881, that in order to prevent sticking of the coating to the hot steel roll used in the gloss calender, the mean Tg value of all polymer components of the binder must be at least 43° C. It is further stated that the drying of the coating is effected at an elevated temperature to assure fusion of the polymer therein, the temperature being about 20° to 60° C higher than the Tg of the polymer incorporated in the coating.

Another U.S. patent which is directed to the production of high-gloss papers by coating the papers with a composition comprising a pigment and a "hard" binder, U.S. Pat. No. 3,634,298 granted Jan. 11, 1972, presents a theoretical explanation as to why "hard" binders promote gloss. The pigment is oriented during the drying cycle by surface tension effects which bring the pigment matrix to minimum volume. This is also the point of maximum orientation and highest gloss in the unfinished condition. Binders, however, freeze the pigment in a random orientation as soon as pigment binding occurs, which prevents maximum orientation and gloss before calendering. This binding action commences when the emulsion is broken in the drying cycle and film formation occurs. As the minimum film forming temperature is increased, the time until coalescense in drying is increased, thereby increasing the time for orientation to occur. By this reasoning, gloss is a function of the glass transition temperature.

As will become apparent hereinafter, such a conclusion is only partially correct. Both of the above-mentioned patents, moreover, teach that the binder be coalesced during the drying cycle in order that it holds the pigment in place. U.S. Pat. No. 3,583,881, column 4, lines 18 through 22; U.S. Pat. No. 3,634,298, column 1, lines 69 through 72.

SUMMARY OF THE INVENTION

The present inventor has found that by ignoring the teaching of the prior art, namely that the binder should be fused or coalesced during the drying step, and, instead, by carefully drying the coated paper web below the Tg temperature, (thus avoiding coalescense), a much higher level of gloss can be produced upon subsequent hot calendering.

In accordance with the method of the present invention, a paper web is coated with a composition containing a "hard" polymeric binder, the coating is dried at a temperature below that at which the binder coalesces, and the coating is calendered at a temperature above the coalescence temperature. Because the binder in the coating is unfused or only partially fused, the pigments in the coating are unbound and hence the surface is much more moldable and capable of producing a much higher level of gloss than if it had been heated above the Tg temperature before the web reached the calender nip.

A further feature of the invention is the discovery of the importance, in the use of hard binders, of the relationship between hardness and temperature. The shape of the curve produced when hardness is plotted against temperature has been found to have meaning for the ease and effectiveness of hard binders in enhancing gloss.

DETAILED DESCRIPTION OF THE INVENTION

Figure 1:
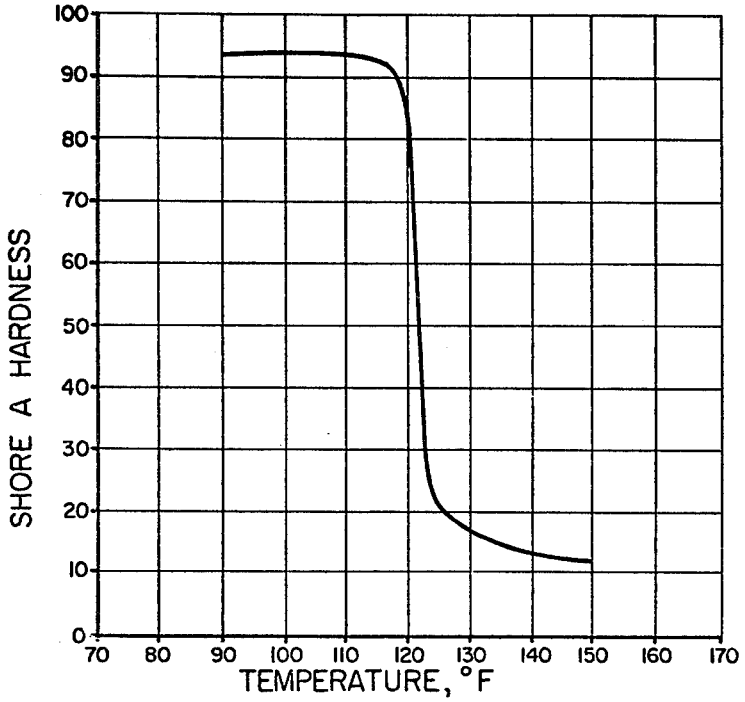
FIG. 1 is a graph depicting, for a representative hard binder of the present invention, the shape of the curve formed when Shore A hardness is plotted against temperature.

Referring now to the drawings, it is to be noted from FIG. 1 that the region of $T_g$ is very short and the slope of the curve in the transition from rigidity to softness is very steep. Thus, polymers having the hardness/temperature characteristics represented by the shape of the curve shown in FIG. 1 are preferred for the practice of the present invention and examples thereof are illustrated in Examples 1, 2, 4 and 5 below. Such polymers are preferred because they begin to flow more readily upon contacting a heated finishing surface and likewise more quickly freeze as the web cools upon leaving the finishing surface because the transition back to hardness occurs over a very narrow temperature range. This rapid return to hardness allows the coating to maintain the high polish or gloss achieved in the nip.

Figure 2:
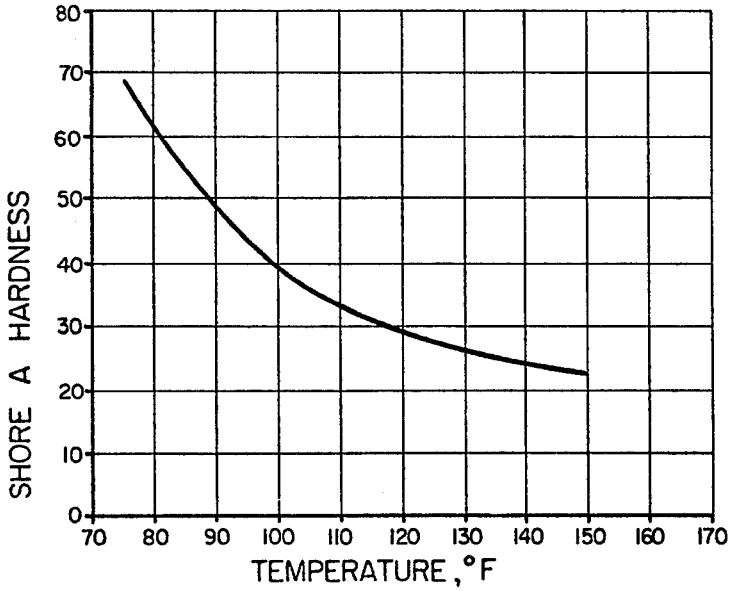
FIG. 2 is a graph depicting, for a representative soft binder, the shape of the curve formed when Shore A hardness is plotted against temperature.

The curve shown in FIG. 2 is representative of a soft polymer, such as that illustrated in Example 3 below, having a Tg below the temperature range shown in the figure. In the temperature region shown, the curve exhibits only the flatness characteristic of the polymer's hardness/temperature relationship in the region well beyond the $T_g$ of the polymer. It may be seen that the hardness of the binder represented in FIG. 1, at a sufficiently high temperature, actually drops below that of the soft binder represented in FIG. 2 at the same temperature. Thus, it is postulated that the better gloss achievable with hard binders is in part attributable to the fact that these hard binders, at a temperature above $T_g$, are actually softer than soft binders and for this reason produce better results even if coalesced or fused prior to finishing.

Figure 3:
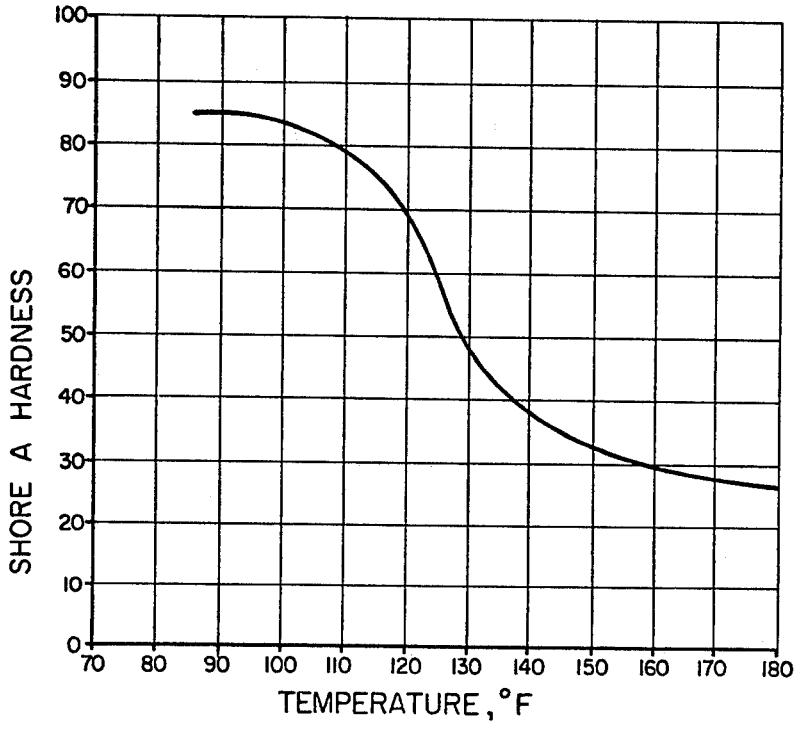
FIG. 3 is a graph depicting, for another hard binder, the shape of the curve formed when Shore A hardness is plotted against temperature.

In the case of the binder represented in FIG. 3, while the region of $T_g$ is very short and the slope of the curve in the transition area is very steep, the change in hardness is less than that depicted in FIG. 1. The curve shown in FIG. 3 indicates that even when this polymer is in its "soft" condition, it is not as easily molded as the polymer represented in FIG. 1. Thus, the type of material represented by the curve in FIG. 3 is less preferred for use in the present invention than that shown in FIG. 1, as the material is harder at the finishing temperature and thus less easily molded.

While the curves shown in FIGS. 1–3 describe the polymer itself, the hardness/temperature characteristics of a composition containing pigment and the binder can also be measured. The shape of the resulting curve can be correlated to the gloss achieved by the use of the coating composition.

The gist of the present discovery is that the effectiveness of a hard binder in producing high gloss when utilized in paper coating compositions is not purely a function of the chemical composition of the binder or of its glass transition temperature, but primarily of the sharpness and depth of the transition in hardness at $T_g$, the glass transition temperature. The preferred binders for use in the present invention are hard at temperatures below $T_g$ and very soft at temperatures above $T_g$.

In accordance with the present invention, an aqueous coating composition comprising paper coating pigment in a binder consisting essentially of a polymer latex having a $T_g$ greater than 100° F is applied to a paper web and dried under conditions such that the temperature of the surface of the coating remains below $T_g$ and the coated paper web is finished at a temperature above $T_g$. As will be herein observed, the temperature of the air employed to dry the coating may be heated to a temperature substantially above $T_g$. Although the phenomenon is not generally recognized, the actual temperature of the surface of a paper web during drying, for example in a high velocity air dryer, has been found by the present inventor to be about 100° F below the temperature of the air circulating in the dryer. The explanation of this temperature difference is that the coating is cooled by the evaporation of water from it (evaporative cooling). The temperature of the surface of the web does not approach the temperature of the circulating air until substantially all the moisture is evaporated from the coated web. As will be understood by one of ordinary skill in the art, the coated web need not be reduced to such a degree of dryness in order to be calendered. Accordingly, it will be seen that rapid drying can be effected by utilizing very hot air yet the drying can be carried out in accordance with the present invention, i.e., at a temperature below $T_g$, by removing the coated web from the dryer before evaporative cooling has ceased.

The expression "consisting essentially" as used herein indicates that the binder is effectively all of the hard, thermoplastic type. The binder component may contain a minor proportion of binder other than the hard, thermoplastic type, provided that the amount is less than that necessary to bind the pigment. In general, this necessary amount is less than 5% based on 100 parts of pigment, but may vary depending on the amount of binder which is absorbed by the paper web. If an amount of soft polymer sufficient to bind the pigment is used, maximum gloss will not be obtained.

A further feature of the invention is the development of several unique and desirable features in the finished coating. It is believed that the final film structure produced in the practice of the invention is different from that produced in the usual soft binders. The hot finishing operation may not completely coalesce the latex particles to a solid impervious film but rather leaves what may be characterized as a "microporous" film in which the latex particles are flowed together but form a semi-continuous structure.

Such a film, in addition to being strong enough to securely bind the pigment, provides certain very desirable attributes to paper coatings. For example, one of the functions of a coated paper is to provide a smooth surface for subsequent printing with gloss ink. A necessary property of this coating is that it also possesses a fine pore structure which can cause the ink to set, via the capillary action of the coating upon the ink or certain more mobile portions of it. This behavior reduces the tendency of printed images to "set-off" or be transferred to the back side of the subsequent sheet deposited on the pile as the sheets are collected on the printing press. The result of the present invention is to produce a coated paper with excellent "ink setting" abilities compared to conventionally coated papers.

Another advantage of such a structure occurs in the production of papers for web offset printing. In order for a paper to have adequate blister resistance, it must possess sufficient porosity to allow the escape of the sheet moisture, which is being driven off by the high temperatures of the oven dryers. The practice of the present invention results in a product of outstanding blister resistance compared to a similar coated paper made with conventional soft binders.

MODE OF OPERATION OF INVENTION

To assist those skilled in the art to practice the present invention, the following modes of operation are suggested by way of illustration. The base stock or fibrous cellulosic substrate to be coated in accordance with the present invention can be one of a wide variety of types depending upon the use for which the product is intended. It can be an internally sized or a surface-sized stock and can vary in weight from a light-weight paper, such a magazine weight, to paperboard weight. As will be understood by those of ordinary skill in the art, to provide a finish of higher quality, it is preferred to prime coat the surface to be finished. The composition of such a prime coat, or even its presence, is not considered to be a critical feature of the present invention.

While the description herein mentions the coating of one surface of the paper, both faces may be so coated if desired. "Ream" as used herein represents 3300 square feet. All weights, unless otherwise indicated, are on a dry weight basis. All gloss readings given herein were made at 75° in accordance with TAPPI T-480 ts-65.

The principles, features and advantages of the invention will be further understood upon consideration of the following specific examples:

EXAMPLE 1

An internally sized paper stock was prime coated on both sides with a conventional aqueous paper coating composition of starch and clay in an amount per side of 2.5 pounds per ream (3.8 grams per square meter).

A coating composition comprising the following was prepared:

| | Parts by Weight |
|---|---|
| Mineral Pigment | 100 |
| Tetrasodium pyrophosphate (dispersant) | 0.15 |
| poly (vinyl acetate) emulsion[1] Tg = 120° F (49° C) | 20 |
| Water in an amount sufficient to produce a coating composition having 65% solids | |

[1]"Gelva E-900" supplied by Monsanto and applied at 1500 feet per minute to one side of the prime-coated web by means of a flooded-nip trailing-blade coater at a rate to provide 7 pounds per ream (10 grams per square meter). Immediately following the application of the coating, it was dried by passing it through an air cap containing rapidly circulating air heated to about 235° F (113° C) under conditions such that the temperature of the coating, due to evaporative cooling, did not exceed 104° F (40° C).

The dried sheet was passed through four successive gloss calender nips with fly rolls being used to guide the web between the nips. The calendering drum temperature was 320° F (160° C) and the nip pressure was about 500 pounds per linear inch (8929 Kg/m). The surface coating had a gloss of 77–78 following the four nip gloss calendering operation.

If the coated paper of this example is dried at a temperature above $T_g$, for example 302° F (150° C), conditioned at 45% relative humidity and finished as above, the gloss reading is approximately 10 units lower.

If the coated and dried paper web of this example is finished by supercalendering instead of by gloss calendering, the surface of the finished coating has a gloss of 80. If the coated paper of this example is dried at a temperature above Tg, for example 302° F (150° C), conditioned at 45% relative humdity and finished by supercalendering the gloss reading is about 74.

EXAMPLE 2

A coating composition comprising the following was prepared:

| | Parts by Weight |
|---|---|
| Mineral Pigment | 100 |
| Tetrasodium pyrophosphate | 0.15 |
| Styrene-isoprene copolymer emulsion[2] Tg = 122° F (50° C) | 20 |
| Water in an amount sufficient to produce a coating composition having 65% solids | |

[2]"XD 3709.08" supplied by Dow Chemical Company at 44% solids and applied to the prime coated base stock of Example 1 in the same manner and weight as in Example 1. Following the application of the coating, the paper was then dried and finished as in Example 1. The surface of the coating had a gloss of 76 following the calendering operation.

If the coated paper of this example is dried at a temperature above Tg, for example 302° F (150° C) conditioned and finished as above, the gloss reading is approximately 10 units lower.

EXAMPLE 3

A coating composition comprising the following was prepared:

| | Parts by Weight |
|---|---|
| Mineral Pigment | 100 |
| Tetrasodium pyrophosphate | 0.15 |
| Styrene-butadiene latex[3] | 18 |
| Tg = 64° F (18° C) | |
| Water in an amount sufficient to produce a coating composition having 62% solids | |

[3]"620" supplied by Dow Chemical Company and applied to the prime-coated base stock of Example 1 in the same manner and weight as in Example 1. Following the application of the coating, the paper was then dried (above $T_g$) and finished as in Example 1. The gloss of the gloss calendered paper was 50.

As previously pointed out, the present invention provides a coated paper with excellent "ink setting" abilities compared to conventionally coated papers. This ink setting property can be described by a test which is not a standarized test but is nevertheless useful for comparison purposes and may be described as follows. A prescribed amount of a specified commercial printing ink is applied as a uniform film to the paper to be tested. At regular intervals of time after the application of the ink to the paper, the inked sample is pressed against a surface (the composition of which remains constant at each interval) under uniform conditions. The density of the ink transferred to the surface is measured optionally and represents the amount of set-off. The end point of the test occurs at that time when the density of the ink transferred reaches a prescribed low value. The time between application of the film of ink to the paper to be tested and the time when the density of the ink set-off reaches the acceptable value is called the "ink set" time.

By way of illustration, the gloss calendered sheet described in Example 1 gave an ink-set time of 275 seconds as measured by the above described test; whereas the gloss calendered sheet of Example 3 yielded a value of 1,075 seconds.

Also as stated above, the present invention provides a product of outstanding blister resistance compared to papers coated with compositions containing conventional soft binders. Blister resistance can be illustrated by performing the following comparison. A uniform film of ink is applied to each side of the sheet to be tested, which has been conditioned at standard relative humidity and temperature conditions. To simulate conditions on commercial web off-set printing presses, the inked sheet is then immediately passed through a hot oven to test for its tendency to blister. Provision is made for monitoring the surface temperature of the sample and blistering is judged visually.

By way of illustration, the gloss calendered sheet of Example 1 showed no evidence of blistering when so tested at a temperature of 300° F. (149° C.), whereas the gloss calendered sheet of Example 3 showed pronounced blistering at 288° F. (142° C.).

EXAMPLE 4

A coating composition comprising the following was prepared:

| | Parts by Weight |
|---|---|
| Clay | 100 |
| Tetrasodium pyrophosphate | 0.15 |
| acrylic polymer emulsion[4] | 16 |
| $T_g$ = 154° F (68° C) | |
| Water in an amount sufficient to produce a coating composition having 63% solids | |

[4]"B-83" supplied by the Rohm and Haas Company at 44% solids and applied to the prime-coated base stock of Example 1 by means of a flooded-nip trailing-blade coater at a rate to provide 8 pounds per ream (12 grams per square meter). Following the application of the coating, the stock was divided into two parts. One part was air-dried at room temperature overnight, and the other oven dried for one minute at 302° F (150° C).

After drying, each part was finished by gloss-calendering. Gloss-calendering consisted of passing the dried, coated sheet through three successive gloss-calender nips. The calendering drum temperature was 245° F (118° C) and the nip pressure was 400 pounds per linear inch (7148 Kg/m). The surface of the air-dried coating had a gloss of 63 following the calendering operation and the surface of the oven-dried coating a gloss of 57.

EXAMPLE 5

A coating composition comprising the following was prepared:

| | Parts by Weight |
|---|---|
| Clay | 100 |
| Tetrasodium pyrophosphate | 0.05 |
| Acrylic polymer emulsion[5] | 16 |
| $T_g$ = 217° F (103° C) | |
| Water in an amount sufficient to produce a coating composition having 63% solids | |

[5]"B-85" supplied by the Rohm and Haas Company and applied to the prime-coated base stock of Example 4 in the same manner and weight as in Example 4. Following the application of the coating, the paper was then dried and finished as in Example 1.

The surface of the air-dried coating had a gloss of 64 following the calendering operation and the surface of the oven-dried coating, a gloss of 56.

It is apparent that other variations and modifications may be made without departing from the present invention. For example, the newly introduced "plastic" pigments, typically polystyrene spheres, may be substituted for mineral pigments. Accordingly, it should be understood that the forms of the present invention described above and shown in the accompanying drawings are illustrative only and not intended to limit the scope of the invention.

What is claimed is:

1. A dried, coated paper web for finishing by calender means to produce high-gloss coated paper which comprises a paper web coated on at least one side with a paper coating pigment and sufficient binder to bind the pigment when the binder has been coalesced, said binder consisting essentially of a hard thermoplastic polymer which is substantially uncoalesced and thereby the pigment unbonded and moldable.

2. The coated paper web according to claim 1 wherein the hard polymer has a hardness/temperature relationship as represented by the curve shown in FIG. 1.

3. The coated paper web according to claim 1 wherein the hard polymer is selected from the group consisting of vinyl acetate, styrene-isoprene and acrylic polymers.

4. The coated paper web according to claim 1 wherein the hard polymer has a glass transition temperature greater than 100° F.

5. A method of producing a dried, coated paper web for finishing by calender means to produce high-gloss coated paper which comprises a paper web coated on at least one side with a paper coating pigment and a binder, said binder consisting essentially of a hard thermoplastic polymer which is substantially uncoalesced, comprising:

1. Applying to the surface of at least on side of the paper web an aqueous composition comprising the pigment and a sufficient quantity of the binder to bind the pigment when the binder has been coalesced, and
2. Drying the coating at a temperature below which substantial coalescence of the binder occurs to thereby leave the pigment unbound and moldable.

6. The coated paper web according to claim 1, wherein the amount of binder which is not hard, thermoplastic polymer is less than 5% based on 100 parts of pigment.

* * * * *